US007470000B2

(12) United States Patent
Beak

(10) Patent No.: US 7,470,000 B2
(45) Date of Patent: Dec. 30, 2008

(54) INK JET HEAD SUBSTRATE, INK JET HEAD, AND METHOD OF MANUFACTURING AN INK JET HEAD SUBSTRATE

(75) Inventor: Oh-Hyun Beak, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 277 days.

(21) Appl. No.: 11/037,081

(22) Filed: Jan. 19, 2005

(65) Prior Publication Data

US 2006/0017774 A1 Jan. 26, 2006

(30) Foreign Application Priority Data

Jul. 21, 2004 (KR) ..... 10-2004-0056961

(51) Int. Cl.
*B41J 2/05* (2006.01)

(52) U.S. Cl. ..... 347/56; 347/62; 347/67; 347/57

(58) Field of Classification Search ..... 347/14, 347/17, 19, 56–67
See application file for complete search history.

(56) References Cited

U.S. PATENT DOCUMENTS

| | | | | |
|---|---|---|---|---|
| 4,740,800 | A | 4/1988 | Kyoshima | 347/67 |
| 5,175,565 | A | 12/1992 | Ishinaga et al. | |
| 5,880,753 | A | 3/1999 | Ikeda et al. | 347/17 |
| 6,074,034 | A | 6/2000 | Maeda | 347/17 |
| 6,102,515 | A | 8/2000 | Edwards et al. | |
| 6,139,131 | A | 10/2000 | Prasad et al. | 347/63 |
| 6,310,636 | B1 * | 10/2001 | Tajika et al. | 347/14 |
| 6,357,863 | B1 * | 3/2002 | Anderson et al. | 347/58 |
| 6,382,773 | B1 * | 5/2002 | Chang et al. | 347/57 |
| 6,971,735 | B2 * | 12/2005 | Saito et al. | 347/57 |
| 7,134,745 | B2 * | 11/2006 | Silverbrook | 347/62 |
| 7,163,272 | B2 * | 1/2007 | Parish et al. | 347/17 |
| 2002/0149657 | A1 * | 10/2002 | Ishinaga et al. | 347/100 |
| 2004/0085407 | A1 * | 5/2004 | Cox et al. | 347/65 |
| 2005/0190232 | A1 * | 9/2005 | Lee et al. | 347/45 |
| 2006/0209131 | A1 * | 9/2006 | Furukawa | 347/56 |

FOREIGN PATENT DOCUMENTS

| | | |
|---|---|---|
| JP | 03-063137 | 3/1991 |
| JP | 09-123457 | 5/1997 |

(Continued)

OTHER PUBLICATIONS

Chinese Office Action dated Mar. 2, 2007 issued in CN 200510072673.9.

(Continued)

*Primary Examiner*—Juanita D Stephens
(74) *Attorney, Agent, or Firm*—Stanzione & Kim, LLP

(57) ABSTRACT

An ink jet head substrate, an ink jet head and a method of manufacturing an ink jet head substrate are provided. The ink jet head substrate includes a substrate having an ink ejection region. An interlayer insulating layer is formed on the substrate. A plurality of pressure-generating elements that generate pressure to eject ink are disposed on the interlayer insulating layer to form a predetermined array. Segment heaters that heat the substrate are disposed at predetermined positions on the substrate. The segment heaters are electrically connected to each other by heater wirings.

39 Claims, 9 Drawing Sheets

FOREIGN PATENT DOCUMENTS

| | | | |
|---|---|---|---|
| JP | 9-174851 | | 7/1997 |
| JP | 10-000774 | * | 1/1998 |
| JP | 11-115173 | | 4/1999 |
| JP | 2001-191515 | * | 7/2001 |
| JP | 2002-103622 | * | 4/2002 |
| KR | 2002-60330 A | | 7/2002 |
| KR | 10-470570 | | 6/2004 |
| KR | 2005-73093 | | 7/2005 |

OTHER PUBLICATIONS

European Search Report dated Apr. 25, 2008 issued in EP 07122521.3.
Korean Office Action dated Jul. 5, 2007 issued in KR 2004-56961.
European Search Report dated May 4, 2006 issued in EP 05254495.4.
Japanese Office Action mailed Jul. 1, 2008 in JP 2005-211915.*

* cited by examiner

INK JET HEAD SUBSTRATE, INK JET HEAD, AND METHOD OF MANUFACTURING AN INK JET HEAD SUBSTRATE

CROSS-REFERENCE TO RELATED APPLICATIONS

This application claims the benefit of Korean Patent Application No. 2004-56961, filed Jul. 21, 2004, the disclosure of which is hereby incorporated herein by reference in its entirety.

BACKGROUND OF THE INVENTION

1. Field of the Invention

The present general inventive concept relates to an ink jet head substrate, an ink jet head, and a method of manufacturing the ink jet head substrate, and more particularly, to an ink jet head substrate provided with a plurality of segment heaters that heat the substrate, an ink jet head provided with the ink jet head substrate, and a method of manufacturing the ink jet head substrate.

2. Description of the Related Art

A thermal ink jet head typically uses a plurality of heat-generating resistors as an electro-thermal transducer on a substrate to create bubbles by instantly heating ink, thereby ejecting ink droplets from the ink jet head. The plurality of heat-generating resistors are located in ink chambers, in which the ink is temporarily stored, before heating. The ink in the ink chambers is ejected by the pressure generated by the heat-generating resistors onto a recording medium through a nozzle that is in fluid communication with the ink chambers.

The temperature of the substrate on which the ink jet head is manufactured affects performance of the ink jet head. That is, when the temperature of the substrate is lower than an ambient temperature, the ink may not be ejected until the temperature of the substrate exceeds a predetermined temperature. In addition, when the temperature of the substrate reaches a high level, a size of the ejected ink droplets increases due to a decrease of ink viscosity and changes in the physical properties of the ink. An increase in the size of the ink droplets causes deterioration in the quality of a printed image. When the temperature of the substrate reaches a higher level, the nozzle may become temporarily incapable of ejecting the ink droplets due to the bubbles generated in the nozzle. The ink may be burned out. Therefore, the temperature of the substrate should be precisely controlled. To this end, a temperature sensor for detecting the temperature of the substrate and a substrate heater for heating the substrate are formed at a predetermined region of the substrate.

An ink jet head substrate provided with temperature sensors and substrate heaters is disclosed in U.S. Pat. No. 5,175,565 to Ishinaga et al., entitled "Ink jet Substrate Including Plural Temperature Sensors And Heaters." According to U.S. Pat. No. 5,175,565, the temperature sensors use a heat resistant device, such as a diode or a transistor. The temperature sensors are disposed at both ends of the ink jet head substrate, and the heaters for heating the ink jet head substrate are disposed at remaining parts of both ends of the ink jet head substrate. In addition, an ink ejection region including heat-generating resistors for generating heat energy for ink ejection is provided on the ink jet head substrate between the heaters. When the temperature of the ink jet head substrate is low, the heaters are operated to heat the ink jet head substrate to an appropriate temperature according to the temperature detected from the temperature sensors. In addition, when the temperature of the ink jet head substrate is abnormally high, a printing operation is stopped until the temperature of the ink jet head substrate decreases to an appropriate temperature.

According to U.S. Pat. No. 5,175,565, the heaters are formed by the same process and of the same material layer as the heat-generating resistors. The process may include forming a high resistance metal layer and a metal wiring layer on the substrate, patterning the high resistance metal layer and the metal wiring layer to form a wiring pattern, and partially removing the metal wiring layer of the wiring pattern to expose a predetermined region of the high resistance metal layer. The metal wiring layer is partially removed by photo and wet etching processes. By partially removing the metal wiring layer, the heat-generating resistors are formed at the ink ejection region, and the substrate heaters are formed at both ends of the ink ejection region, simultaneously. The heat-generating resistors and the substrate heaters are the exposed regions of the high resistance metal layer.

However, the substrate heaters are typically formed to have an area wider than that of the heat-generating resistors in order to heat the entire ink jet head substrate. Therefore, a problem may occur when the heat-generating resistors and the substrate heaters are exposed by the same wet etching process as described above. That is, when the wet etching process is performed based on the area of the heat-generating resistors, the substrate heaters having an area wider than that of the heat-generating resistors may not be sufficiently exposed. As a result, the substrate heaters may not perform inherent functions. In addition, when the process of exposing the heat-generating resistors and the wet etching process of exposing the heaters are separately performed, the process becomes overly complicated.

Furthermore, the heaters are formed at both ends of the ink jet head substrate. Therefore, it may be difficult to uniformly heat the entire ink jet head substrate, and especially, to uniformly control the temperature of the ink jet head substrate in the ink ejection region where the ink is actually ejected.

SUMMARY OF THE INVENTION

The general inventive concept provides an ink jet head substrate with a substrate heater having improved reliability.

The general inventive concept provides an ink jet head with the ink jet head substrate.

The general inventive concept provides a method of manufacturing the ink jet head substrate.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an ink jet head substrate with a plurality of segment heaters that heat a substrate having an ink ejection region. An interlayer insulating layer may be disposed on the substrate. A plurality of pressure-generating elements that generate pressure to eject ink may be disposed on the interlayer insulating layer to form a predetermined array of pressure-generating elements. The plurality of segment heaters that heat the substrate may be disposed at predetermined positions on the substrate. The segment heaters may be electrically connected to each other by heater wirings.

The segment heaters may be disposed to form a matrix array on the interlayer insulating layer at outer portions of both ends of the ink ejection region. Furthermore, a temperature sensing line may be buried in the interlayer insulating layer in a line shape to be located adjacent to the pressure-generating elements. The temperature sensing line may be made of aluminum.

The interlayer insulating layer may include a lower interlayer insulating layer and an upper interlayer insulating layer, which are sequentially stacked on the substrate, and the segment heaters may be disposed on the lower interlayer insulating layer to be located adjacent to pressure-generating elements. Furthermore, the temperature sensing line may be disposed on an intermediate interlayer insulating layer interposed between the upper interlayer insulating layer and the lower interlayer insulating layer to be located adjacent to the pressure-generating elements in a line shape. The temperature sensing line may be made of aluminum.

The segment heaters may be made of any metal selected from a group including tantalum (Ta), tungsten (W), chrome (Cr), molybdenum (Mo), titanium (Ti), zirconium (Zr) and hafnium (Hf), or an alloy including the selected metal. Other materials may also be used to make the segment heaters. The pressure-generating elements may be made of the same material as the segment heaters. In addition, the heater wirings may be made of aluminum.

The segment heaters may have an area substantially equal to the pressure-generating elements.

The foregoing and/or other aspects and advantages of the present general inventive concept may also be achieved by providing an ink jet head including an ink jet head substrate having an ink ejection region. An interlayer insulating layer may be disposed on the substrate. A plurality of pressure-generating elements that generate pressure to eject ink are disposed on the interlayer insulating layer of the ink ejection region to form a predetermined array of pressure-generating elements. Segment heaters that heat the substrate may be disposed at predetermined positions of the substrate. The segment heaters may be electrically connected to each other by heater wirings. A passivation layer may be disposed on the substrate having the pressure-generating elements, the segment heaters, and the heater wirings. An ink-supply passage may be disposed to pass through the substrate, the interlayer insulating layer, and the passivation layer adjacent to the pressure-generating elements. A flow path forming body may be disposed on the passivation layer to define an ink flow path provided as a flow passage of the ink. A plurality of nozzles pass through the flow path forming body to correspond to the pressure-generating elements.

The foregoing and/or other aspects and advantages of the present general inventive concept may also achieved by providing a method of manufacturing an ink jet head substrate. The method includes preparing a substrate having an ink ejection region. An interlayer insulating layer may be formed on the substrate. A plurality of pressure-generating elements that generate pressure to eject ink may be formed on the interlayer insulating layer of the ink ejection region. A plurality of segment heaters that heat the substrate; and heater wirings electrically connected to the segment heaters may be formed at predetermined positions of the substrate.

The segment heaters may be formed on the interlayer insulating layer at outer portions of both ends of the ink ejection region in a matrix array.

The segment heaters may be formed and buried in the interlayer insulating layer to be located adjacent to the pressure-generating elements.

The segment heaters may be made of any metal selected from a group including tantalum (Ta), tungsten (W), chrome (Cr), molybdenum (Mo), titanium (Ti), zirconium (Zr) and hafnium (Hf), or an alloy including the selected metal. Alternatively, other materials may also be used to make the segment heaters. The pressure-generating elements may be made of the same material as the segment heaters. In addition, the heater wirings may be made of aluminum.

The segment heaters may have an area substantially equal to the pressure-generating elements.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
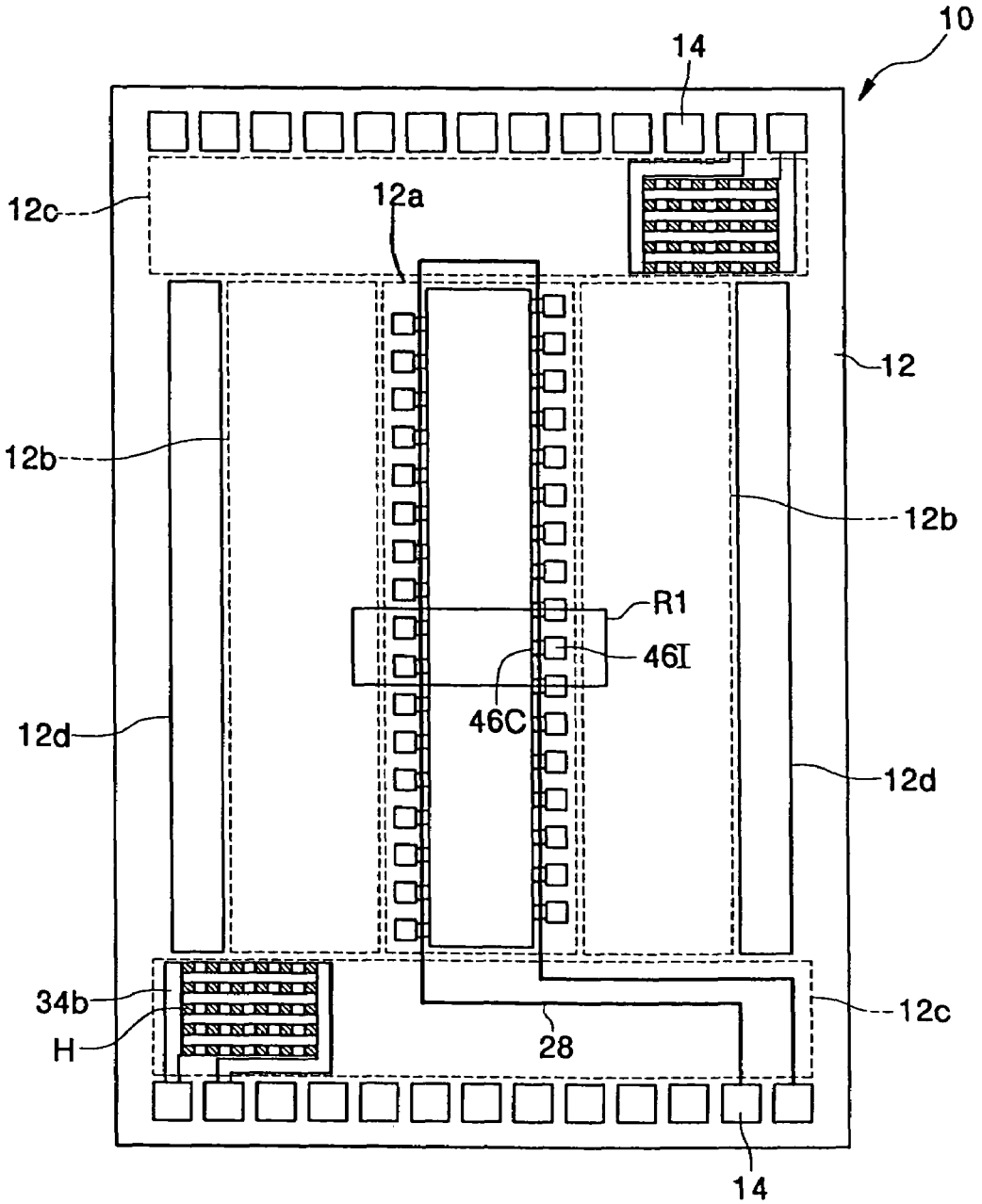
FIG. 1 is a plan view of an ink jet head in accordance with an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
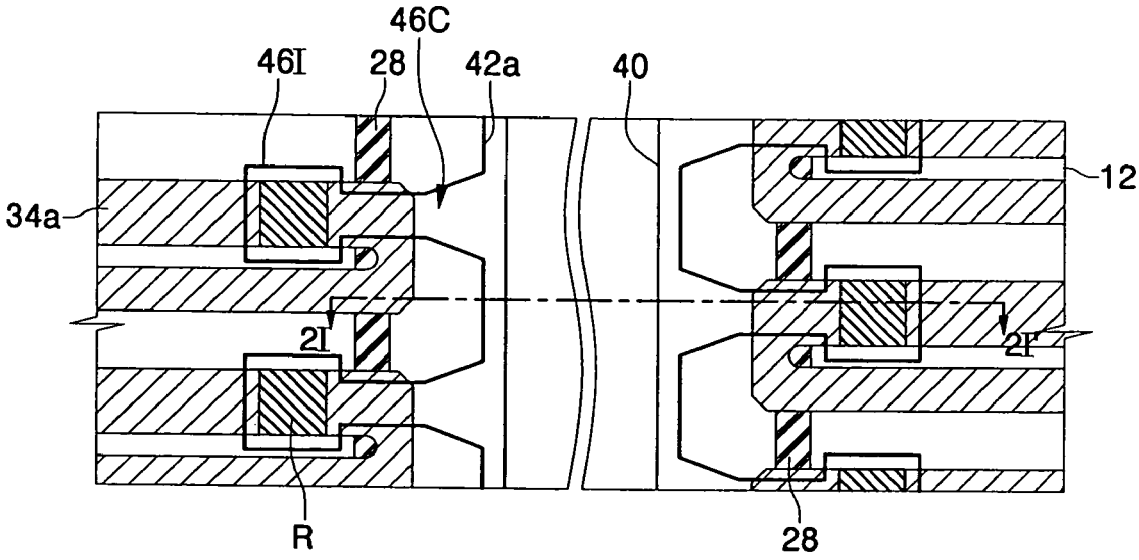
FIG. 2 is an enlarged plan view of a portion R1 of an ink ejection region shown in FIG. 1.
Figure 3A:
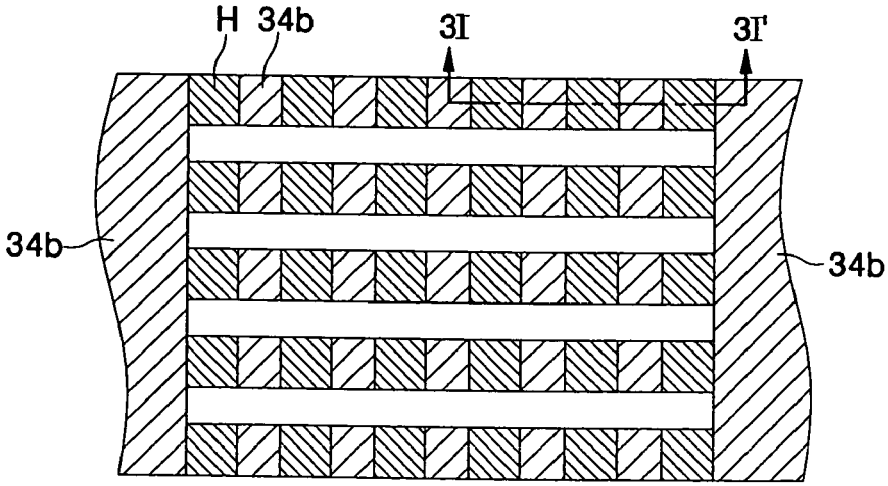
FIG. 3A is an enlarged plan view of the segment heaters H shown in FIG. 1.

FIG. 1 is a plan view of an ink jet head in accordance with an embodiment of the present general inventive concept, and FIG. 2 is an enlarged plan view of a portion R1 of an ink ejection region shown in FIG. 1. In addition, FIG. 3A is an enlarged plan view of segment heaters H shown in FIG. 1. FIGS. 5 to 9 are cross-sectional views illustrating a method of manufacturing an ink jet head in accordance with an embodiment of the present general inventive concept. In FIGS. 5 to 9, region 'A' is a cross-sectional view of an ink jet head substrate taken along a line 2*l*-2*l*' in FIG. 2 that illustrates the ink ejection region, and region 'B' is a cross-sectional view of an ink jet head substrate taken along a line 3*l*-3*l*' in FIG. 3A that illustrates the segment heaters.

First, the ink jet head in accordance with various embodiments of the present general inventive concept will be described.

Referring to FIGS. 1, 2, 3A and 9, the ink jet head includes an ink jet head substrate 10 and a flow path forming body 42 disposed on the ink jet head substrate 10 to define an ink flow path provided as a flow passage. The ink jet head substrate 10 includes insulating layers disposed on a substrate 12, discrete devices and wirings disposed in or on the insulating layers. In accordance with the present general inventive concept, the ink jet head substrate 10 may include the substrate 12 and all other members disposed on the substrate 12 excluding the flow path forming body 42. The substrate 12 functions as a support layer of the ink jet head substrate 10. The substrate 12 may be a silicon substrate used in a semiconductor device manufacturing process and having a thickness of about 500 μm.

An ink ejection region 12*a* is defined on the substrate 12. The ink ejection region 12*a*, from which the ink is actually ejected, may be defined at a center portion of the substrate 12. A plurality of pressure-generating elements that generate pressure to eject ink are disposed on the ink ejection region 12*a*. In accordance with the present general inventive concept, the pressure-generating elements may be heat-generating resistors R provided as electro-thermal transducers. The heat-generating resistors R may be made of a high resistance metal. For example, the heat-generating resistors may be made of any metal selected from a group including tantalum (Ta), tungsten (W), chrome (Cr), molybdenum (Mo), titanium (Ti), zirconium (Zr) and hafnium (Hf), or an alloy including the selected metal. Other materials may also be used to make the heat-generating resistors R. The heat-generating resistors R may be disposed on an interlayer insulating layer, which may be formed on an entire surface of the substrate 12. The interlayer insulating layer may include a lower interlayer insulating layer 22 and an upper interlayer insulating layer 30, which are sequentially stacked on the substrate 12. In addition, an intermediate interlayer insulating layer 26 may be alternatively interposed between the lower interlayer insulating layer 22 and the upper interlayer insulating layer 30. The interlayer insulating layers 22, 26 and 30 may be formed of a silicon oxide ($SiO_2$) layer, a boro-phospho-silicate glass (BPSG) and a silicon nitride (SiN) layer, respectively. Alternatively, other materials may also be used to form the interlayer insulating layers. The heat-generating resistors R are disposed on the upper interlayer insulating layer 30 of the ink ejection region 12*a* to form a predetermined array of heat-generating resistors R. As shown in FIG. 1, the heat-generating resistors R may be disposed in, but are not limited to, two rows. Both ends of the heat-generating resistors R are electrically connected to the ink ejection wirings 34*a*, respectively. The ink ejection wirings 34*a* may be made of a metal, such as aluminum, having a resistance relatively lower than that of the heat-generating resistors R. The ink ejection wirings 34*a* may be electrically connected to conductive pads 14 or source and drain regions of a MOS transistor in a power transistor region to be described below.

The conductive pads 14 may be disposed along longitudinal ends of the substrate 12. The conductive pads 14 may be located at the same level as the ink ejection wirings 34*a*. The conductive pads 14 electrically connect the ink jet head to an external circuit (not shown).

Power transistor regions 12*b* and address regions 12*d* may be located at both sides of the ink ejection region 12*a*. In addition, logic circuit regions 12*c* may be located outside both longitudinal ends of the ink ejection region 12*a*. CMOS transistors are located in the logic circuit regions 12*c* to perform addressing and decoding. MOS transistors, which are electrically connected to the heat-generating resistors R, are located on the power transistor regions 12*b*. The MOS transistors include source and drain regions formed in the substrate 12 and gate electrodes located on a channel region between the source and drain regions. The logic circuit regions 12*c* turn on the MOS transistors located on the power transistor regions 12*b* through an address line located on the address regions 12*d*. The MOS transistors may be located on the substrate 12 in the lower interlayer insulating layer 22.

In accordance with an embodiment of the present general inventive concept, substrate heaters are disposed on the upper interlayer insulating layer 30 outside both ends of the ink ejection region 12*a*. That is, the substrate heaters may be disposed on the upper interlayer insulating layer 30 on the logic circuit regions 12*c*. The substrate heaters include a plurality of segment heaters H. The segment heaters H may have an area substantially equal to the heat-generating resistors R. The segment heaters H are electrically connected to each other by heater wirings 34*b*. In addition, the heater wirings 34*b* may be electrically connected to the conductive pads 14. As shown in FIG. 3A, the segment heaters H may be disposed to form, but are not limited to, a matrix array. For instance, the segment heaters H may be modified to have various numbers and arrangements within an extent electrically connected by the heater wirings 34*b*.

Figure 3B:
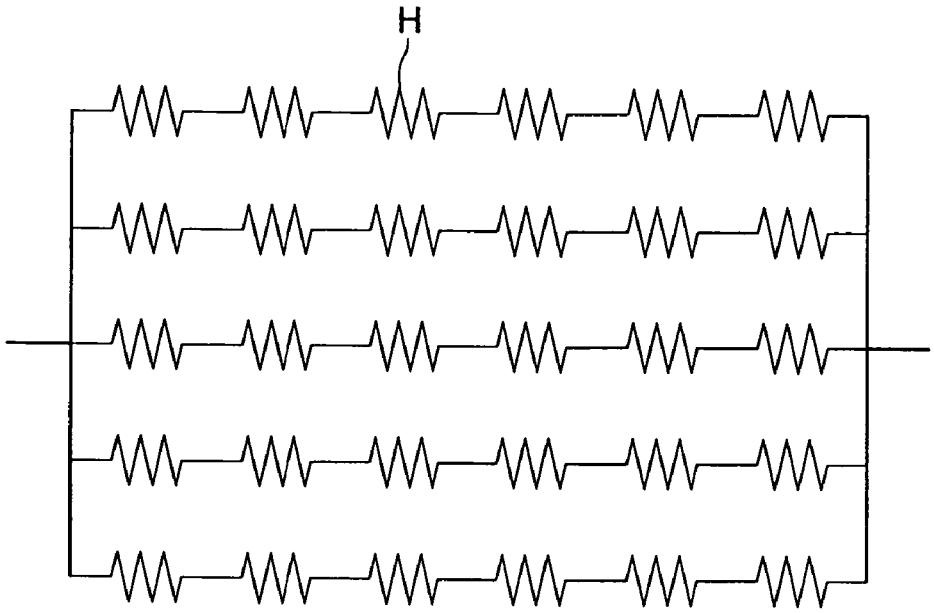
FIG. 3B is a schematic circuit diagram of FIG. 3A.
Figure 4A:
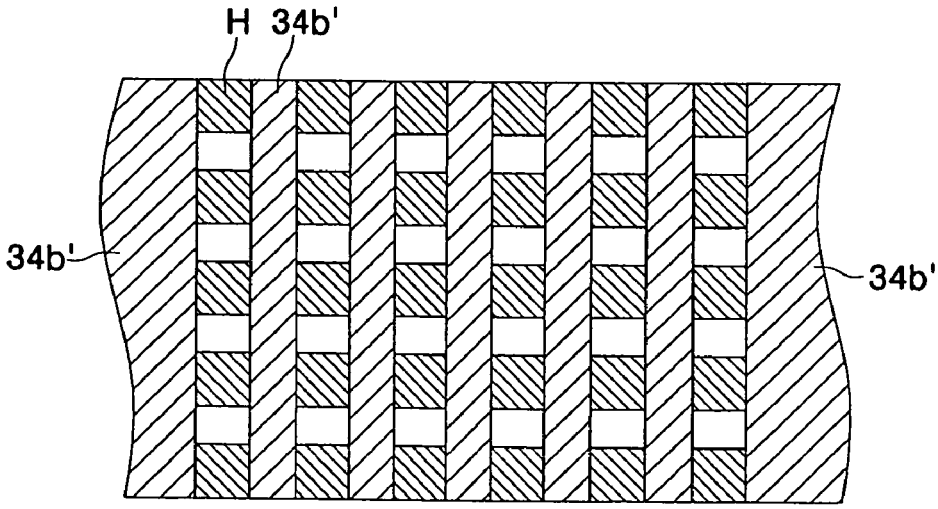
FIG. 4A is a plan view illustrating segment heaters in accordance with another embodiment of the present general inventive concept.

FIG. 3B is a schematic circuit diagram of the segment heaters H shown in FIG. 3A. In addition, FIG. 4A is a plan view illustrating electrical connections of the segment heaters H in accordance with another embodiment of the present general inventive concept, and FIG. 4B is a schematic circuit diagram of FIG. 4A.

Figure 4B:
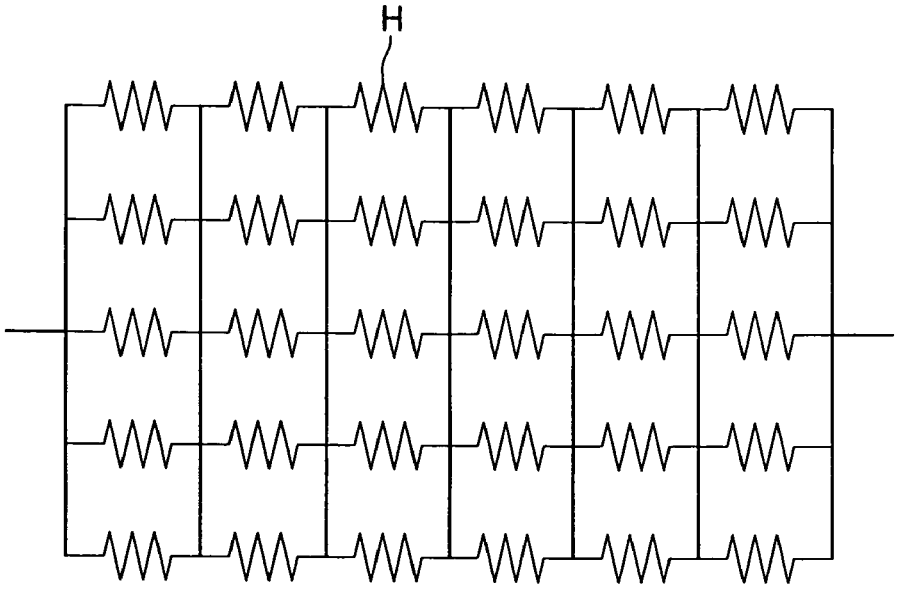
FIG. 4B is a schematic circuit diagram of FIG. 4A.
Figure 5:
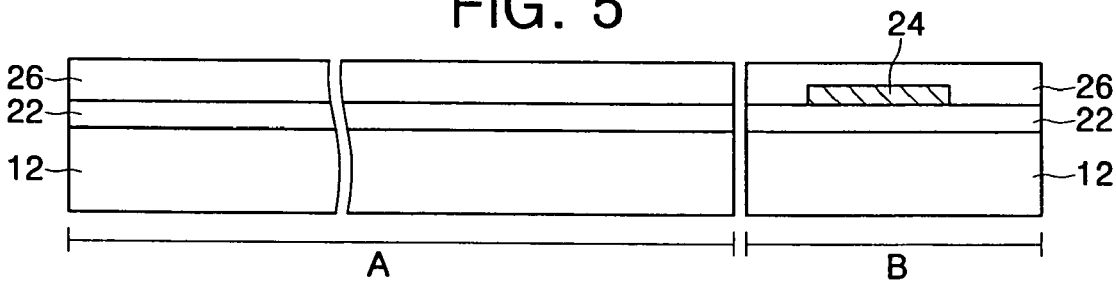
FIGS. 5 to 9 are cross-sectional views illustrating a method of manufacturing an ink jet head in accordance with an embodiment of the present general inventive concept.
Figure 6:
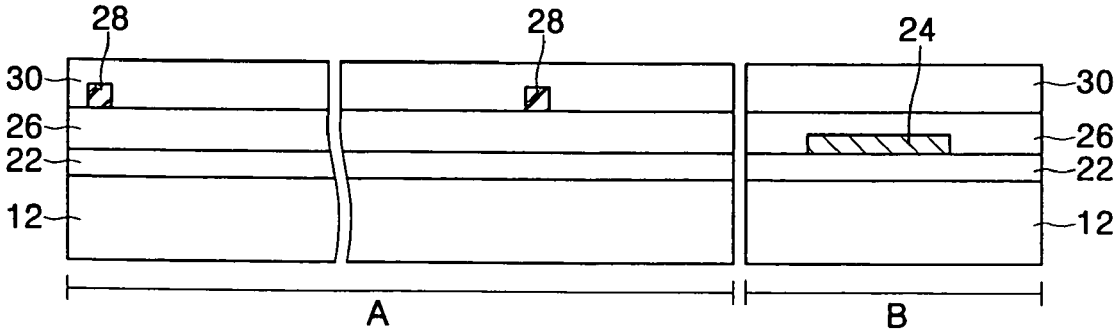
Figure 7:
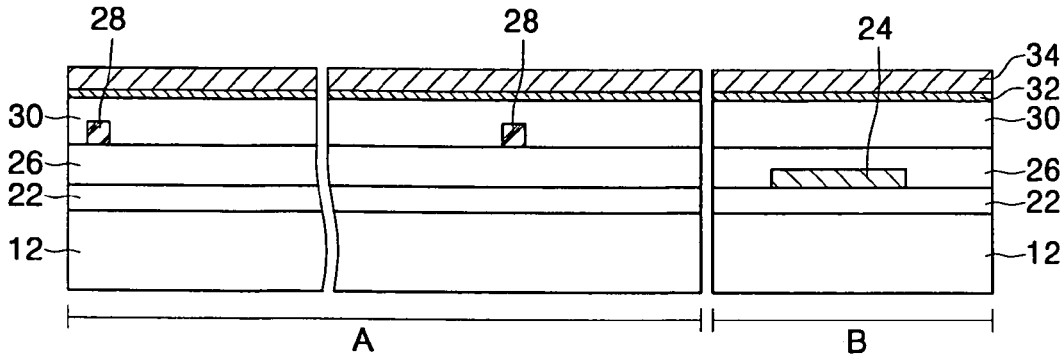
Figure 8:
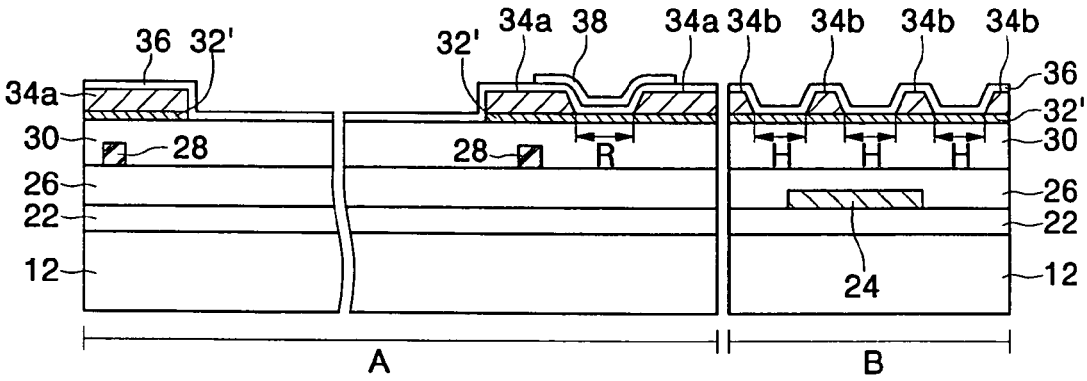
Figure 9:
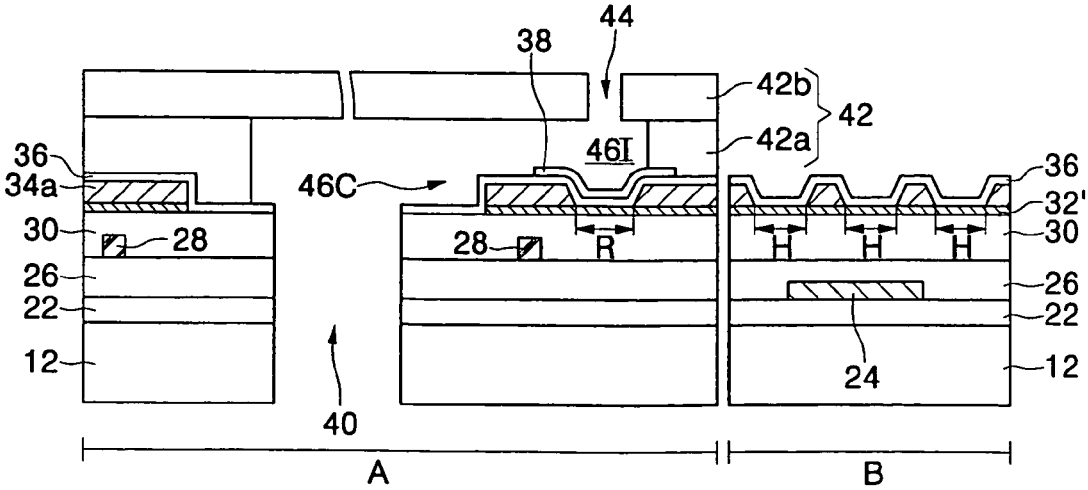

Referring to FIGS. 3A to 4B, the segment heaters H may be disposed to form a matrix array having the same number of rows and columns. In addition, in order to allow the heater wirings 34*b* to adjust a total resistance of the segment heaters H, the segment heaters H may be connected to each other in series and/or in parallel. For example, when a driving voltage of the ink jet head is about 10~15 V (volts), the total resistance of the segment heaters H may be adjusted to have a resistance between about 30 and about 200 Ω (Ohms). In the embodiment shown in FIGS. 3A and 3B, six segment heaters H connected in series are connected to each other in 6 rows. In this case, the total resistance of the segment heaters H may be equal to a separate resistance of the segment heaters H. Alternatively, and as shown in FIGS. 4A and 4B, the segment heaters H may be connected to each other in parallel by heater wirings 34*b*'.

Referring to FIGS. 1, 2, 3A and 9, the segment heaters H and the heater wirings 34*b* may be disposed at the same level as the heat-generating resistors R and the ink ejection wirings 34*a*, respectively. In addition, the segment heaters H and the heater wirings 34*b* may be formed by the same process and formed of the same material as the heat-generating resistors R and the ink ejection wirings 34*a*, respectively. In this case, the segment heaters H may be made of any metal selected from a group including tantalum (Ta), tungsten (W), chrome (Cr), molybdenum (Mo), titanium (Ti), zirconium (Zr) and hafnium (Hf), or an alloy including the selected metal. Alternatively, other materials may also be used to make the segment heaters. In addition, the heater wirings 34*b* may be made of aluminum.

In accordance with the present general inventive concept as described above, the plurality of segment heaters H having an area substantially equal to the heat-generating resistors R and are formed in the same process as the heat-generating resistors R. Therefore, as can be seen from the following description, it is possible to prevent reliability of the process from deteriorating due to an area difference between the heat-generating resistors and the substrate heaters caused by the segment heaters having a wider area than that of the heat-generating resistors. In addition, the plurality of segment heaters H is combined to constitute the substrate heater, thereby facilitating adjustment of a total resistance of the substrate heater.

Referring continuously to FIGS. 1, 2, 3A and 9, a line-shaped temperature sensing line 28, which is buried in the upper interlayer insulating layer 30, may be disposed on the intermediate interlayer insulating layer 26 to be located adjacent to the pressure-generating elements. Each end of the temperature sensing line 28 is connected to the conductive pads 14. The temperature sensing line may be made of aluminum. As shown in FIG. 1, the temperature sensing line 28 is disposed adjacent to the heat-generating resistors R. Therefore, the substrate temperature of the ink ejection region 12*a* from which the ink is actually ejected may be more precisely detected. In accordance with some embodiments of the present general inventive concept, the temperature sensing line 28 may be omitted, and the intermediate interlayer insulating layer may also be omitted. When the temperature sensing line is omitted, the temperature of the substrate 12 may be measured by forming a diode type temperature sensor in the substrate 12 of the logic circuit regions 12*c* or forming a heat resistant device, such as aluminum, on the interlayer insulating layer of the logic circuit regions 12*c*.

A passivation layer 36 that covers the heat-generating resistors R, the ink ejection wirings 34*a*, the segment heaters H, and the heater wirings 34*b* is disposed on the upper interlayer insulating layer 30. The passivation layer 36 functions to prevent the heat-generating resistors R, the ink ejection wirings 34*a*, the segment heaters H, and the heater wirings 34*b* from corroding due to contact with the ink or exposure to air. The passivation layer 36 may be formed of a silicon nitride layer. In addition, an anti-cavitation layer 38 is disposed on the passivation layer 36 to at least overlap with the heat-generating resistors R. The anti-cavitation layer 38 may be made of tantalum.

An ink-supply passage 40, which passes through the substrate 12, the interlayer insulating layers 22, 26 and 30, and the passivation layer 36, is disposed in the ink ejection region 12*a*. As shown in FIG. 2, the ink-supply passage 40 may be disposed between the heat-generating resistors R arranged in two rows. In this case, the temperature sensing line 28 may be disposed between the heat-generating resistors R and the ink-supply passage 40, when viewed in a plan view.

The flow path forming body 42 that defines the ink flow path, which is provided as the flow passage of the ink, is disposed on the passivation layer 36. The ink flow path includes a plurality of ink chambers 46I having the heat-generating resistors R therein, and ink channels 46C in fluid communication with the ink chambers 46I. The flow path forming body 42 includes a chamber layer 42*a* that defines sidewalls of the ink flow path, and a nozzle layer 42*b* disposed on the chamber layer 42*a* to cover at least the ink ejection region 12*a*. In addition, nozzles 44 corresponding to the heat-generating resistors R, are disposed to pass through the nozzle layer 42*b*.

Hereinafter, a method of manufacturing an ink jet head in accordance with an embodiment of the present general inventive concept will be described. The method of manufacturing an ink jet head includes a process of manufacturing the ink jet head substrate 10 and a process of forming the flow path forming body 42 on the ink jet head substrate 10. Hereinafter, the process of manufacturing the ink jet head substrate 10 will be described with reference to FIGS. 5 to 8 sequentially, and then the process of forming the flow path forming body 42 will be described with reference to FIG. 9.

Referring to FIGS. 1, 2, 3A and 5, the substrate 12 with the ink ejection region 12*a* is prepared. MOS transistors may be formed on the substrate 12. The MOS transistors may be located in power transistor regions (12*b* in FIG. 1) and logic circuit regions (12*c* in FIG. 1).

The lower interlayer insulating layer 22 is formed on the substrate 12. The lower interlayer insulating layer 22 insulates the MOS transistor from metal wirings, which are to be formed in the following process. The lower interlayer insulating layer 22 may be formed of a silicon oxide layer, a BPSG layer, or a silicon nitride layer. A lower wiring 24 is formed on the lower interlayer insulating layer 22. Address lines may also be formed on the address regions (12*d* in FIG. 1) during the formation of the lower wiring 24. The lower wiring 24 is capable of electrically connecting the address line and the CMOS transistors in the logic circuit regions 12*c*. The lower wiring 24 may be formed by forming an aluminum layer on the lower interlayer insulating layer 22 and patterning the aluminum layer. An intermediate interlayer insulating layer 26 may be formed on the substrate 12 having the lower wiring 24. The intermediate interlayer insulating layer 26 may be formed of a silicon oxide layer or a BPSG layer.

Referring to FIGS. 1, 2, 3A and 6, a temperature sensing line 28 may be formed on the intermediate interlayer insulating layer 26. The temperature sensing line 28 may be formed by forming an aluminum layer on the intermediate interlayer insulating layer 26 and then patterning the aluminum layer. The temperature sensing line 28 may be formed to have a line shape along the ink ejection region 12*a*. Then, an upper interlayer insulating layer 30 is formed on the substrate 12 having the temperature sensing line 28. The upper interlayer insulating layer 30 may be formed of a silicon oxide layer or a BPSG layer. Alternatively, the process of forming the temperature sensing line 28 may be omitted, and the process of forming the intermediate interlayer insulating layer 26 may also be omitted. In this case, the upper interlayer insulating layer 30 may be directly formed on the lower interlayer insulating layer 22 to cover the lower wiring 24.

Referring to FIGS. 1, 2, 3A and 7, a high resistance metal layer 32 and a metal wiring layer 34 are sequentially formed on the upper interlayer insulating layer 30. The high resistance metal layer 32 may be made of a metal layer or an alloy layer including a material selected from a group including tantalum (Ta), tungsten (W), chrome (Cr), molybdenum (Mo), titanium (Ti), zirconium (Zr) and hafnium (Hf). Other materials may also be used to make the high resistance metal layer. The metal wiring layer 34 may be formed of a material layer having a resistance lower than that of the high resistance metal layer 32. For example, the metal wiring layer 34 may be formed of an aluminum layer by a sputtering method.

Referring to FIGS. 1, 2, 3A and 8, ink ejection patterns are formed at least on the upper interlayer insulating layer 30 of the ink ejection region (12*a* in FIG. 1) by sequentially patterning the metal wiring layer 34 and the high resistance metal layer 32, and simultaneously forming the heater patterns on the upper interlayer insulating layer 30 outside both ends of the ink ejection region (12*a* in FIG. 1). In particular, the heater patterns are formed on the upper interlayer insulating layer 30 of the logic circuit region (12*c* in FIG. 1). The ink ejection patterns and the heater patterns include a high resistance metal layer pattern 32' and a metal wiring layer pattern, which are sequentially stacked. Then, the metal wiring layer pattern is selectively removed to form ink ejection wirings 34*a* and heater wirings 34*b* in order to expose a predetermined region of the high resistance metal layer pattern 32'. The metal wiring layer pattern may be removed by photo and wet etching processes. The high resistance metal layer pattern 32' exposed by the ink ejection wirings 34*a* is provided as the heat-generating resistors R, and the high resistance metal layer pattern 32' exposed by the heater wirings 34*b* is provided as the segment heaters H. In this process, conductive pads 14 may be formed together on the upper interlayer insulating layer 30 of the both ends of the substrate 12. The ink ejection wirings 34*a*, which are connected to one side of the heat-generating resistors R, may be electrically connected to source and drain regions of the MOS transistor formed on the substrate of the power transistor regions (12*b* in FIG. 1) by a conductive contact structure (not shown) passing through the interlayer insulating layers 22, 26 and 30 on the power transistor regions (12*b* in FIG. 1). In addition, the ink ejection wirings 34*a*, which are connected to the other side of the heat-generating resistors R, may be directly connected to the conductive pads 14. The heater wirings 34*b* may be also directly connected to the conductive pads 14.

The heat-generating resistors R are formed to have a predetermined array in the ink ejection region (12*a* in FIG. 1). In addition, the segment heaters H may be formed to be disposed in a matrix array on the logic circuit region (12*c* in FIG. 1). The segment heaters H are formed to have an area substantially equal to the heat-generating resistors R.

In accordance with an embodiment of the present general inventive concept and as mentioned above, the segment heaters H that have an area substantially equal to the heat-generating resistors R may be formed by the same wet etching process as the heat-generating resistors R. Therefore, unlike the conventional substrate heaters having an area wider than that of the heat-generating resistors, the present general inventive concept is capable of preventing deterioration of the reliability of the substrate heaters formed by the same wet etching process as the heat-generating resistors.

Referring to FIGS. 1, 2, 3A and 8, a passivation layer 36 covering the heat-generating resistors R, the segment heaters H, the ink ejection wirings 34*a*, and the heater wirings 34*b* is formed. The passivation layer 36 may be formed of a silicon nitride layer. Then, an anti-cavitation layer 38, which at least overlaps with the heat-generating resistors R, is formed on the passivation layer 36. The anti-cavitation layer 38 may be formed by forming a tantalum layer on the passivation layer 36 and then patterning the tantalum layer.

Referring to FIGS. 1, 2, 3A and 9, the flow path forming body 42 provided with nozzles 44 is formed on the substrate 12, at which the anti-cavitation layer 38 is formed. The ink flow path including ink chambers 46I having the heat-generating resistors R therein and ink channels 46C in fluid communication with the ink chambers are defined by the flow path forming body 42. The flow path forming body 42 includes a chamber layer 42*a* forming sidewalls of the ink flow path and a nozzle layer 42*b* formed on the chamber layer 42*a* to cover at least the ink ejection region (12*a* in FIG. 1). The flow path forming body 42 may be formed by various methods according to technologies known to those skilled in the art. In accordance with an embodiment of the present general inventive concept, the flow path forming body may be formed by the following process.

First, a negative photoresist layer is formed on the substrate 12 having the anti-cavitation layer 38. The negative photoresist layer is patterned by exposure and development processes to form the chamber layer 42*a*. Then, a sacrificial layer that fills between the chamber layers 42*a* is formed, and the nozzle layer 42*b* is formed on the chamber layer 42*a* and the sacrificial layer. The nozzle layer 42*b* may be formed of the negative photoresist layer. The nozzle layer 42*b* is patterned by the exposure and development processes to form the nozzles 44. Then, the substrate 12 having the nozzles is etched from the rear surface to form an ink-supply passage 40. The interlayer insulating layers 22, 26 and 30 are etched together. Then, the sacrificial layer is removed to form the ink chambers 46I and the ink channels 46C at the region where the sacrificial layer is removed.

Figure 10:
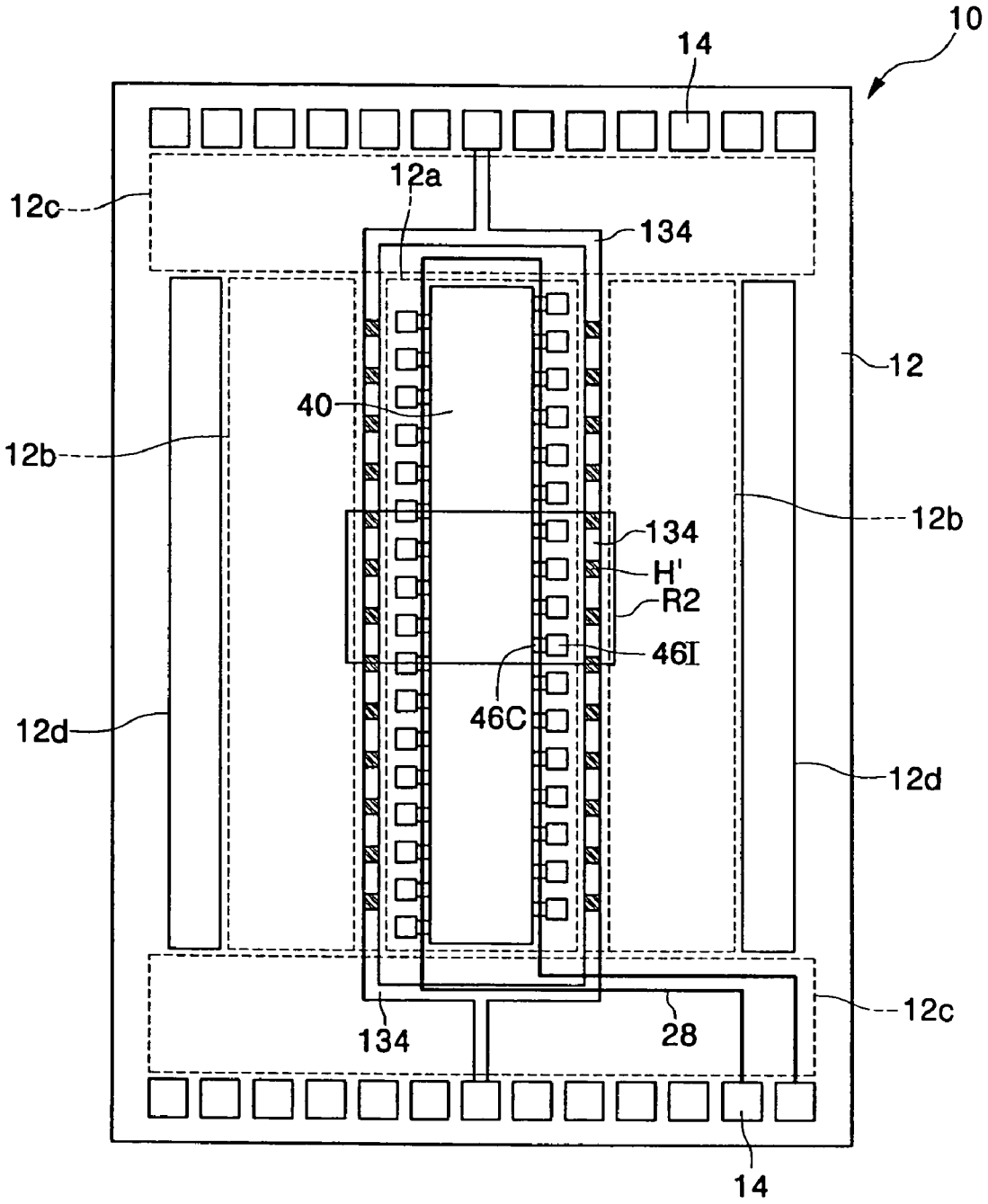
FIG. 10 is a plan view of an ink jet head in accordance with an embodiment of the present general inventive concept.
Figure 11:
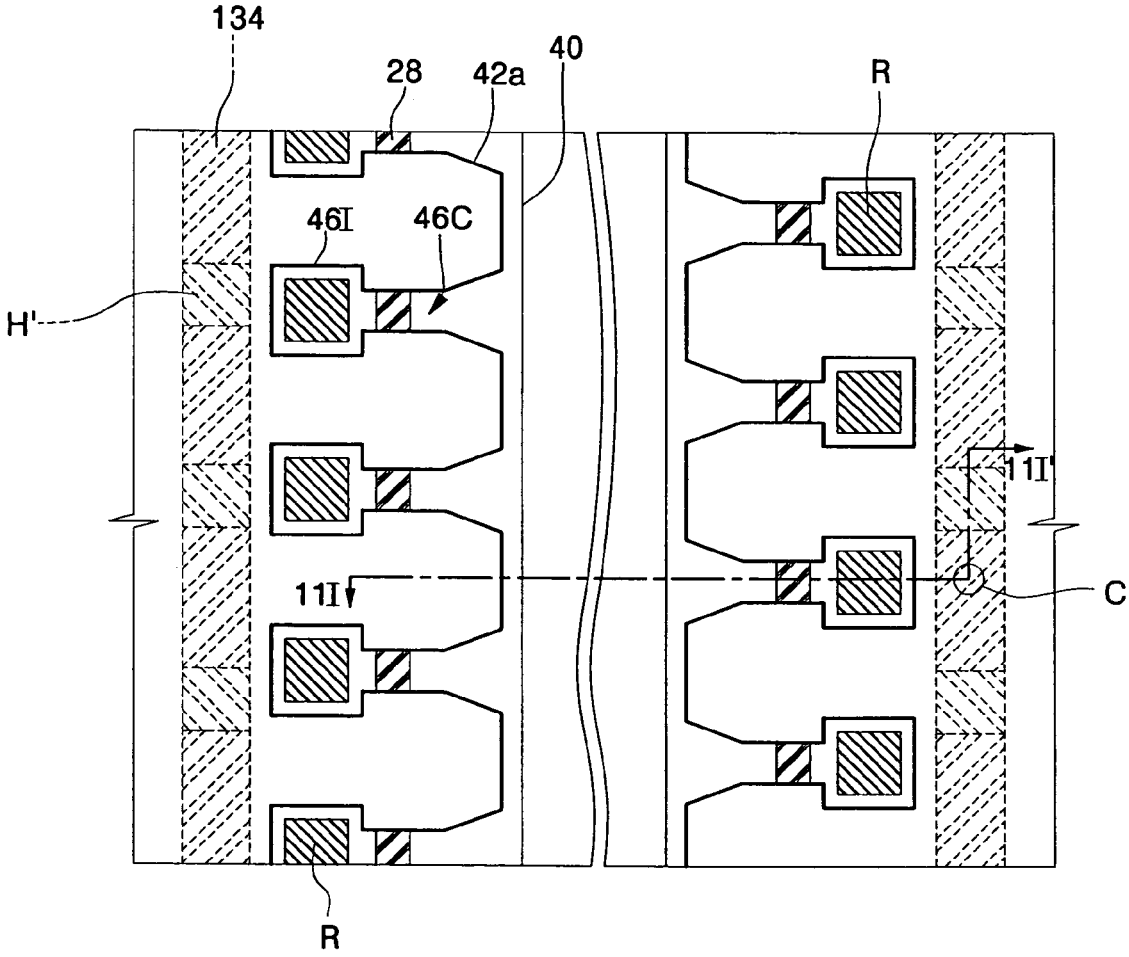
FIG. 11 is an enlarged plan view of a portion R2 of an ink ejection region shown in FIG. 10.

FIG. 10 is a plan view of an ink jet head in accordance with another embodiment of the present general inventive concept, and FIG. 11 is an enlarged plan view of a portion R2 of an ink ejection region shown in FIG. 10. In addition, FIGS. 12 to 15 are cross-sectional views, taken along the line 11*l*-11*l*' of FIG. 11, illustrating a method of manufacturing an ink jet head in accordance with another embodiment of the present general inventive concept. In FIGS. 12 to 15, lines C-C are corresponding to a corner portion C in FIG. 11. Hereinafter, descriptions of members designated by the same reference numeral as an embodiment of the present general inventive concept described in FIGS. 1 to 9 may be similarly applied to the description of the FIGS. 10 to 15. Therefore, their description will be omitted.

First, an ink jet head in accordance with another embodiment of the present general inventive concept will be described.

Figure 15:
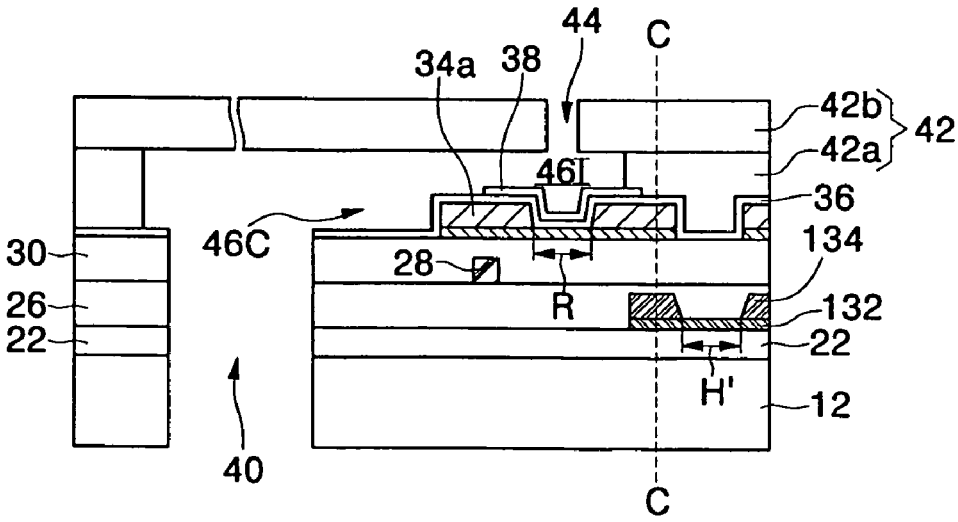

Referring to FIGS. 10, 11 and 15, segment heaters H' may be disposed adjacent to pressure-generating elements R. The segment heaters H' disposed along an array of the pressure-generating elements R may be variously changed, but are not limited to, the number and arrangement in consideration of a total resistance of the segment heaters H'. The segment heaters H' are electrically connected to each other by heater wirings 134, and ends of the heater wirings 134 are electrically connected to the conductive pads 14, respectively. The segment heaters H' and the heater wirings 134 are disposed at a different level from the heat-generating resistors R and the ink ejection wirings 34*a* in order to insulate against the heat-generating resistors R and the ink ejection wirings 34*a*. The segment heaters H' and the heater wirings 134 may be disposed on the lower interlayer insulating layer 22, and the heat-generating resistors R and the ink ejection wirings 34*a* may be disposed on the upper interlayer insulating layer 30. While the ink ejection wirings 34*a* are omitted in FIG. 11 to clearly illustrate the segment heaters H' and the heater wirings 134, the ink ejection wirings 34*a* shown in FIG. 2 may be applied to have the same arrangement as FIG. 11.

The segment heaters H' have an area substantially equal to the heat-generating resistors R. However, in accordance with another embodiment of the present general inventive concept, since the segment heaters H' and the heat-generating resistors R are formed at a different level by a separate process, area and shape of the segment heaters H' may be modified on more relaxed conditions.

When a line-shaped temperature sensing line 28, which is buried in the upper interlayer insulating layer 30, is disposed on the intermediate interlayer insulating layer 26, the temperature sensing line 28 and the segment heaters H' may be spaced apart from each other with the heat-generating resistors R interposed between them, when viewed in a plan view.

In accordance with another embodiment of the present general inventive concept and as described above, the segment heaters H' may be disposed adjacent to the heat-generating resistors R to be uniformly distributed on the substrate 12. As a result, it becomes possible to uniformly heat the substrate 12. In particular, the segment heaters H' may be disposed in the vicinity of the heat-generating resistors R to uniformly heat the substrate 12 at a portion where the ink is actually ejected, thereby preventing performance of the ink ejection during an initial printing operation from deteriorating.

Hereinafter, a method of manufacturing an ink jet head in accordance with another embodiment of the present general inventive concept will be described.

Figure 12:
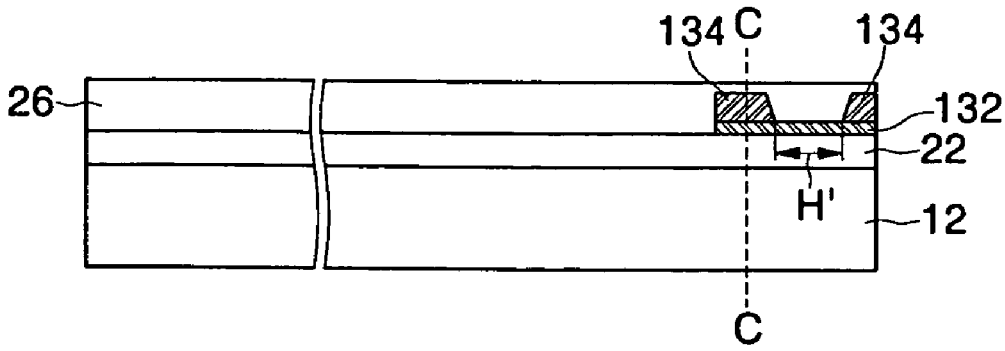
FIGS. 12 to 15 are cross-sectional views, taken along the line 11*l*-11*l*' of FIG. 11, illustrating a method of manufacturing an ink jet head in accordance with another embodiment of the present general inventive concept.

Referring to FIGS. 11 and 12, a lower interlayer insulating layer 22 is formed on a substrate 12. Segment heaters H' and heater wirings 134 that electrically connect the segment heaters H' to each other are formed on the lower interlayer insulating layer 22. The segment heaters H' and the heater wirings 134 may be formed by the following process. A heater material layer and a heater-wiring layer are sequentially formed on the lower interlayer insulating layer 22. The heater material layer may be made of a metal layer or an alloy layer including any material selected from a group including tantalum (Ta), tungsten (W), chrome (Cr), molybdenum (Mo), titanium (Ti), zirconium (Zr) and hafnium (Hf). Alternatively, other materials may be used to make the heater material layer. The heater-wiring layer may be formed of a material layer such as an aluminum layer having a resistance lower than that of the heater material layer. Then, the heater-wiring layer and the heater material layer are patterned to form a heater pattern. The heater pattern includes a heater material layer pattern 132 and a heater-wiring layer pattern, which are sequentially stacked. The heater pattern may be formed to have a line shape along an ink ejection region (12*a* in FIG. 10). Then, the heater-wiring layer pattern is selectively removed by performing photo and wet etching processes to form the heater wirings 134. The heater material layer pattern 132 at a portion exposed by the heater wirings 134 is provided as the segment heaters H'. In this process, address lines may be formed together at address line regions 12*d*. Then, an alternative intermediate interlayer insulating layer 26 may be formed on the substrate 12 having the segment heaters H' and the heater wirings 134 thereon.

Figure 13:
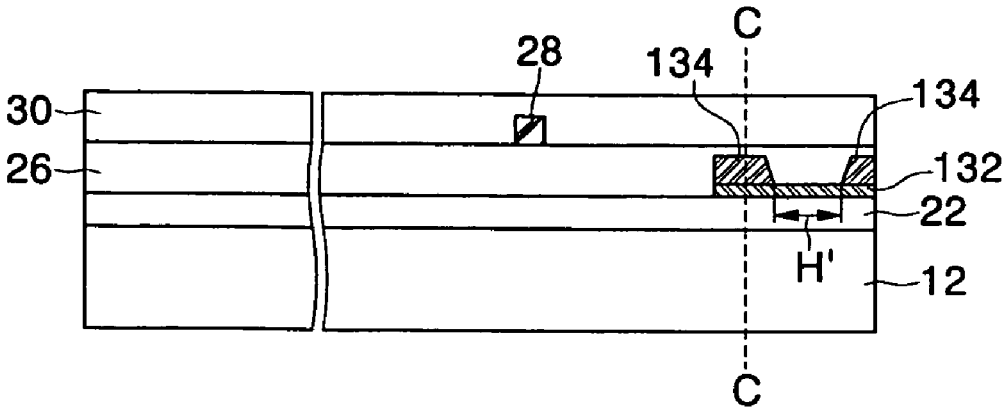

Referring to FIGS. 11 and 13, a temperature sensing line 28 may be formed on the intermediate interlayer insulating layer 26 by using an aluminum layer. Alternatively, a process of forming the temperature sensing line 28 may be omitted. In this case, a process of forming the intermediate interlayer insulating layer 26 may be also omitted. An upper interlayer insulating layer 30 is formed on the substrate 12 having the temperature sensing line 28 thereon. When the process of forming the temperature sensing line 28 is omitted, the upper interlayer insulating layer 30 may be directly formed on the lower interlayer insulating layer 22 to cover the segment heaters H' and the heater wirings 134.

Figure 14:
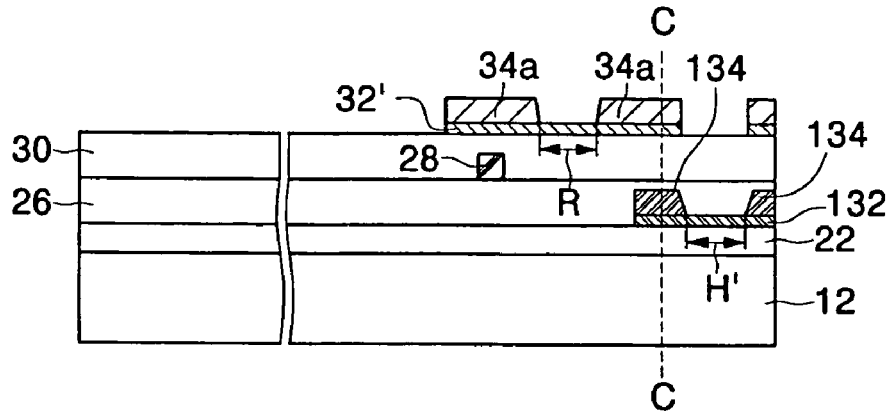

Referring to FIGS. 11 and 14, heat-generating resistors R and ink ejection wirings 34*a* are formed on the upper interlayer insulating layer 30. The heat-generating resistors R and the ink ejection wirings 34*a* may be formed by the following process. A high resistance metal layer and a metal wiring layer are sequentially formed on the upper interlayer insulating layer 30. The high resistance metal layer may be formed of the same material layer as the heater material layer. The high resistance metal layer may be made of a metal layer or an alloy layer including any material selected from a group including tantalum (Ta), tungsten (W), chrome (Cr), molybdenum (Mo), titanium (Ti), zirconium (Zr) and hafnium (Hf). Alternatively, other materials may also be used to make the high resistance metal layer. The metal wiring layer may be made of an aluminum layer. Then, the metal wiring layer and the high resistance metal layer are patterned to form an ink ejection pattern. The ink ejection pattern includes a high resistance metal layer pattern 32' and a metal wiring layer pattern, which are sequentially stacked. Then, the metal wiring layer pattern is selectively removed to form the ink ejection wirings 34*a*. The high resistance metal layer pattern at a portion exposed by the ink ejection wirings 34*a* is provided as the heat-generating resistors R. The heat-generating resistors R are formed adjacent to the segment heaters H' in the ink ejection region (12*a* in FIG. 10).

Referring to FIGS. 11 and 15, after the heat-generating resistors R and the ink ejection wirings 34*a* are formed, a passivation layer 36 that covers the heat-generating resistors R and the ink ejection wirings 34*a* is formed on the upper interlayer insulating layer 30. An anti-cavitation layer 38 is then formed on the passivation layer 36 to at least overlap with the heat-generating resistors R. Then, an ink-supply passage 40 and a flow path forming body 42 are formed by performing the process described in FIG. 9.

As can be seen from the foregoing, the present general inventive concept provides a plurality of segment heaters as a substrate-heating member that heat a substrate. The process of forming the segment heaters may be combined to the process of forming the pressure-generating elements that generate pressure to eject ink to simplify the entire process, thereby improving reliability of the segment heaters.

In addition, the segment heaters may be uniformly distributed on the substrate in comparison with the conventional substrate heater having a wide area. As a result, it becomes possible to uniformly heat the substrate. In particular, the segment heaters are disposed adjacent to the pressure-generating element that actually eject the ink, thereby preventing performance of the ink ejection during an initial printing operation from deteriorating.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink jet head substrate comprising:

a substrate having an ink ejection region;

an interlayer insulating layer disposed on the substrate;

a plurality of pressure-generating elements disposed to form a predetermined array on the interlayer insulating layer of the ink ejection region to generate pressure to eject ink;

a plurality segment heaters, each segment having substantially similar dimensions to each other, disposed at predetermined positions on the substrate to heat the substrate; and heater wirings that electrically connect the segment heaters to each other, wherein each of the segment heaters has an area substantially equal to the area of the pressure-generating elements.

2. The ink jet head substrate according to claim 1, wherein the segment heaters are disposed to form a matrix array on the interlayer insulating layer at outer portions of each end of the ejection region.

3. The ink jet head substrate according to claim 2, wherein the matrix array includes areas of high resistance metal and areas of relatively low resistance metal.

4. The ink jet head substrate according to claim 3, wherein the areas of high resistance metal are arranged in series.

5. The ink jet head substrate according to claim 3, wherein the areas of high resistance metal are arranged in parallel.

6. The ink jet head substrate according to claim 3, wherein the areas of low resistance metal correspond to the heater wirings and the areas of high resistance metal correspond to the segment heaters.

7. The ink jet head substrate according to claim 2, further comprising:

a temperature sensing line buried in the interlayer insulating layer to be located adjacent to the pressure-generating elements in a line shape.

8. The ink jet head substrate according to claim 7, wherein the temperature sensing line is made of aluminum.

9. The ink jet head substrate according to claim 1, wherein the interlayer insulating layer includes a lower interlayer insulating layer and an upper interlayer insulating layer, which are sequentially stacked, and the segment heaters are disposed on the lower interlayer insulating layer to be located adjacent to the pressure-generating elements.

10. The ink jet head substrate according to claim 9, further comprising a temperature sensing line disposed adjacent to the pressure-generating elements in a line shape on an intermediate interlayer insulating layer interposed between the upper interlayer insulating layer and the lower interlayer insulating layer.

11. The ink jet head substrate according to claim 10, wherein the temperature sensing line is made of aluminum.

12. The ink jet head substrate according to claim 1, wherein the segment heaters are made of a metal selected from a group consisting of tantalum (Ta), tungsten (W), chrome (Cr), molybdenum (Mo), titanium (Ti), zirconium (Zr) and hafnium (Hf), or an alloy including the selected metal.

13. The ink jet head substrate according to claim 12, wherein the pressure-generating elements are made of the same material as the segment heaters.

14. The ink jet head substrate according to claim 1, wherein the heater wirings are made of aluminum.

15. The ink jet head substrate according to claim 1, wherein the segment heaters and the pressure-generating elements are formed on a single layer of the substrate and the segments heaters and the pressure-generating elements are formed by a single etching process.

16. The ink jet head substrate according to claim 1, further comprising:

a passivation layer disposed on the substrate to protect the segment heaters, the pressure generating elements, and the heater wirings.

17. The ink jet head substrate according to claim 1, wherein the pressure-generating elements are heat-generating resistors made from a high-resistance metal.

18. The ink jet head substrate according to claim 17, wherein the heat-generating resistors are electrically connected to ink ejection wirings made from a metal with a relatively low resistance.

19. The ink jet head substrate according to claim 1, further comprising:

at least one address region located at a latitudinal end of the substrate to perform addressing; and at least one logic region located at a longitudinal end of the ink ejection region to perform logic functions.

20. The ink jet head substrate according to claim 19, wherein the segment heaters are located in the at least one logic region.

21. The ink jet head substrate according to claim 1, wherein the interlayer insulating layer is formed of one of a silicon oxide layer, a boro-phospho-silicate glass layer, and a silicon nitride layer.

22. The ink jet head substrate according to claim 1, further comprising:

an ink supply passage disposed between the pressure-generating elements that passes through the substrate and the interlayer insulating layer;

a flow path forming body that defines an ink flow path, wherein the flow path forming body includes a plurality of ink chambers having the pressure-generating elements disposed therein.

23. The ink jet head substrate according to claim 22, further comprising:

a plurality of nozzles that correspond to the pressure-generating elements and are disposed above the ink chambers.

24. An ink jet head comprising:

an ink jet head substrate comprising:

a substrate having an ink ejection region, an interlayer insulating layer disposed on the substrate, a plurality of pressure-generating elements disposed to form a predetermined array on the interlayer insulating layer of the ink ejection region to generate pressure to eject ink, a plurality of similarly dimensioned segment heaters disposed at predetermined positions on the substrate to heat the substrate, and heater wirings that electrically connect the segment heaters to each other;

a passivation layer covering the substrate having the pressure-generating elements, the segment heaters, and the heater wirings;

an ink-supply passage passing through the substrate, the interlayer insulating layer, and the passivation layer;

a flow path forming body disposed on the passivation layer to define an ink flow path provided as a flow passage of ink; and a plurality of nozzles located above the flow path forming body to correspond to the pressure-generating elements, wherein each of the segment heaters has an area substantially equal to the area of the pressure-generating elements.

25. The ink jet head according to claim 24, wherein the segment heaters are disposed to form a rectangle matrix array on the interlayer insulating layer at outer portions of each end of the ink ejection region.

26. The ink jet head according to claim 25, wherein the matrix array includes areas of high resistance metal and areas of relatively low resistance metal.

27. The ink jet head according to claim 26, wherein the areas of high resistance metal are arranged in series.

28. The ink jet head according to claim 26, wherein the areas of high resistance metal are arranged in parallel.

29. The ink jet head according to claim 26, wherein the areas of relatively low resistance metal correspond to the heater wirings and the areas of high resistance metal correspond to the segment heaters.

30. The ink jet head according to claim 24, wherein the interlayer insulating layer includes a lower interlayer insulating layer and an upper interlayer insulating layer, which are sequentially stacked, and the segment heaters are disposed on the lower interlayer insulating layer to be located adjacent to the pressure-generating elements.

31. The ink jet head according to claim 24, wherein the segment heaters are made of a metal selected from a group consisting of tantalum (Ta), tungsten (W), chrome (Cr),molybdenum (Mo), titanium (Ti), zirconium (Zr) and hafnium (Hf), or an alloy including the selected metal.

32. The ink jet head according to claim 31, wherein the pressure-generating elements are made of the same material as the segment heaters.

33. The ink jet head according to claim 24, wherein the heater wirings are made of aluminum.

34. The ink jet head according to claim 24, wherein the segment heaters and the pressure-generating elements are formed on a single layer of the substrate and the segment heaters and the pressure-generating elements are formed by a single etching process.

35. The ink jet head according to claim 24, wherein the plurality of pressure-generating elements are heat-generating resistors made from a high-resistance metal.

36. The ink jet head according to claim 24 further comprising:

at least one address region located at a latitudinal end of the substrate to perform addressing; and at least one logic region located at a longitudinal end of the ink ejection region to perform logic functions.

37. The ink jet head according to claim 36, further comprising:

at least one power transistor region located at a latitudinal end of the ink ejection region including at least one power transistor to provide power to the pressure-generating elements.

38. The ink jet head according to claim 36, wherein the segment heaters are located in the at least one logic region.

39. The ink jet head according to claim 24, wherein the interlayer insulating layer is formed of one of a silicon oxide layer, a boro-phospho-silicate glass layer, and a silicon nitride layer.

* * * * *